United States Patent [19]

Ringersma et al.

[11] Patent Number: 4,596,128

[45] Date of Patent: Jun. 24, 1986

[54] METHOD AND APPARATUS FOR BENDING ELONGATE WORKPIECES, PARTICULARLY PIPES

[75] Inventors: Jelke Ringersma, Klundert; Johannes M. Hofstede, Berkel en Rodenrijs, both of Netherlands

[73] Assignee: Cojafex BV, Rotterdam, Netherlands

[21] Appl. No.: 758,811

[22] Filed: Jul. 25, 1985

[30] Foreign Application Priority Data

Jul. 26, 1984 [DE] Fed. Rep. of Germany ..... 3427639

[51] Int. Cl.[4] ..... B21D 7/024; B21D 7/16

[52] U.S. Cl. ..... 72/128; 72/369

[58] Field of Search ..... 72/128, 149, 202, 342, 72/364, 369

[56] References Cited

U.S. PATENT DOCUMENTS

| | | | |
|---|---|---|---|
| 783,716 | 2/1965 | Brinkman | 72/128 |
| 1,891,338 | 12/1932 | Snell | 72/128 |
| 2,461,323 | 2/1949 | Hille | 72/342 |
| 2,480,774 | 8/1949 | Rossheim et al. | 72/342 |
| 3,229,489 | 1/1966 | Huet | 72/128 |
| 3,368,377 | 2/1968 | Hirayama et al. | 72/128 |
| 3,724,258 | 4/1973 | Hofstede et al. | 72/342 |
| 4,151,732 | 5/1979 | Hofstede et al. | 72/128 X |
| 4,177,661 | 12/1979 | Schwarzbach et al. | 72/128 |
| 4,254,649 | 3/1981 | Cervenka et al. | 72/128 |

FOREIGN PATENT DOCUMENTS

| | | |
|---|---|---|
| 1935100 | 1/1971 | Fed. Rep. of Germany . |
| 2210715 | 10/1972 | Fed. Rep. of Germany . |
| 2220910 | 12/1973 | Fed. Rep. of Germany . |
| 2112019 | 2/1975 | Fed. Rep. of Germany . |
| 2738394 | 2/1982 | Fed. Rep. of Germany . |
| 2822618 | 7/1982 | Fed. Rep. of Germany . |
| 142607 | 12/1970 | Netherlands . |
| 778842 | 7/1957 | United Kingdom . |
| 1383364 | 2/1975 | United Kingdom . |

OTHER PUBLICATIONS

DIN (German Industrial Standard), 2413, Jun. 1966, pp. 2–7.

*Primary Examiner*—E. Michael Combs
*Attorney, Agent, or Firm*—Spencer & Frank

[57] ABSTRACT

A method and apparatus for bending elongate workpieces, particularly pipes, by applying a bending moment to the workpiece while inductively heating a cross-sectional zone of the workpiece to provide a non-uniform temperature distribution along the circumference of this cross-sectional zone by means of an induction loop which surrounds the workpiece and by cooling the workpiece in at least one adjacent zone. According to the method of the invention, within a partial region of the circumference of the workpiece to be bent, which partial region is to be set at a relatively low temperature, the electrical current of the induction loop is branched off into a plurality of partial currents of which at least one is inductively directed primarily onto the cross-sectional zone to be heated and at least one other partial current is inductively directed primarily onto an adjacent zone of the workpiece, and the inductive heating of the respective adjacent zone is partially or completely cancelled out by cooling. The branching may be realized in the apparatus by a bypass line which divides a portion of the induction loop into parallel branches.

22 Claims, 17 Drawing Figures

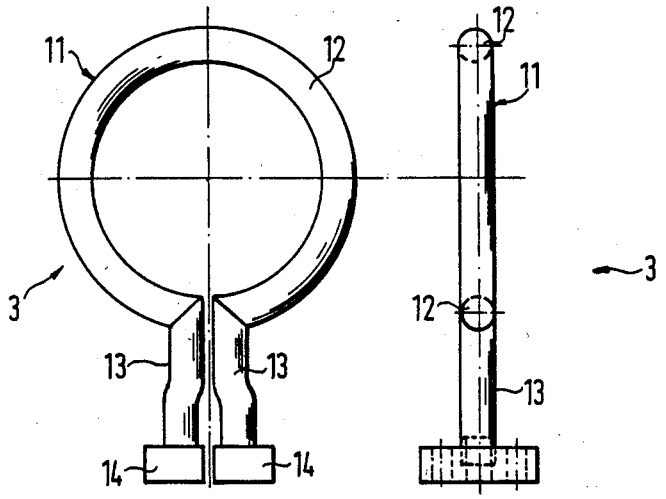
FIG.2a
(PRIOR ART)
FIG.2b
(PRIOR ART)
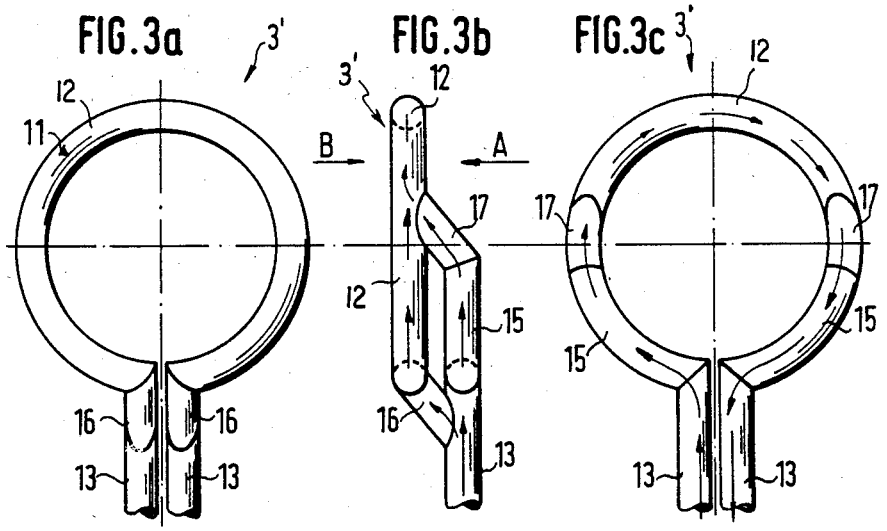

FIG.6a
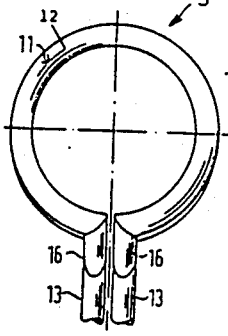
FIG.6b
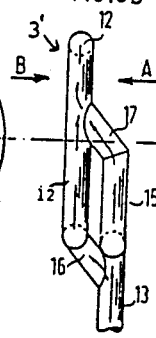
FIG.6c
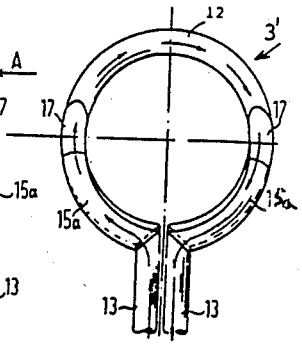
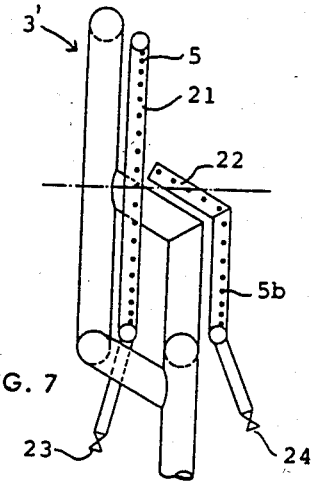
FIG. 7
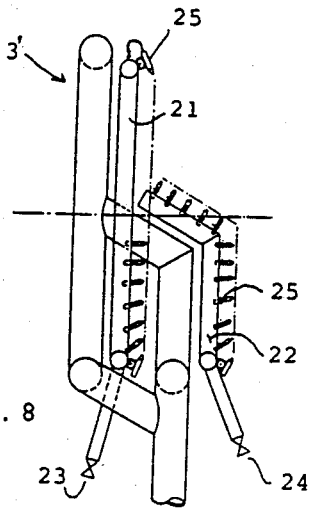
FIG. 8
FIG. 9
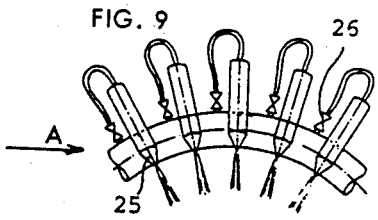
FIG. 10
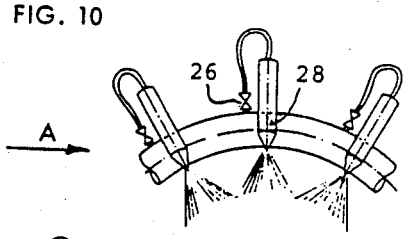
FIG. 9a
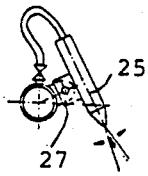
FIG. 10a
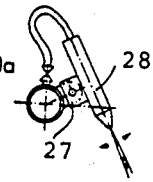

METHOD AND APPARATUS FOR BENDING ELONGATE WORKPIECES, PARTICULARLY PIPES

BACKGROUND OF THE INVENTION

The present invention relates to an improved method and apparatus for bending elongate workpieces, particularly pipes. More specifically, the present invention relates to an improved method and apparatus for bending elongate workpieces, particularly pipes, of the type wherein a bending moment is applied to the workpiece while inductively heating a cross-sectional zone of the workpiece, by means of an induction loop which surrounds the cross-sectional. zone, such that a nonuniform temperature distribution along the circumference of the cross-sectional zone results, and wherein the bend workpiece is subsequently cooled. In addition to pipes, the inductively heatable and thus electrically conductive elongate workpieces employed also include rods, in particular, and, more generally, all those elongate pieces which can be bent by means of nonuniform temperature distribution along the circumference of a heated, usually narrow circumferential zone.

Nonuniform heating of a cross-section, for example, of pipes to be bent, and more generally, of elongate workpieces to be bent, is of great significance in some special cases and additionally, from a general point of view, results in special advantages. There are materials which tend to crack when subjected to extensive plastic deformation, particularly elongation, if such deformation takes place at temperatures above the so-called Ac3 point, being the temperature at which the material structure changes into an austenitic phase (approximately 800° to 850° C. for steel). If now, while a bend is being made, the temperature at the side being elongated or stretched, the so-called extrados, is kept low, e.g. at 750° C., and at the the so-called intrados, it is kept high, e.g. at 950° C., the neutral bending line is displaced toward the extrados. This results in more upsetting at the intrados and less stretching or elongation at the extrados. Less elongation at the extrados is advantageous not only because it decreases the danger of crack formation in that area, but also because less elongation means less thinning of the pipe wall. By using the correct temperature difference between extrados and intrados, it is possible, starting with pipes having normal wall thicknesses, to produce bends which meet the conditions of maximum permissible wall thinning (at the extrados) and wall thickening (at the intrados), as prescribed, for example, in DIN (German Industrial Standard) 2413.

Heating of the elongate workpieces, e.g. pipes, by means of an inductor to produce progressive bending is widely known. For example, the general aspect of such heating is disclosed in Dutch Pat. No. 142,607 and Federal Republic of Germany Pat. No. 2,112,019.

A first possibility for nonuniform heating by means of an inductor to produce progressive bending in pipes and other elongate workpieces with the aim of influencing or correcting the degree of deformation and change in wall thickness is disclosed in German Pat. No. 2,738,394 which provides for asymmetrical placement of the inductor. One of several alternative possibilities disclosed in DE-OS (Federal Republic of Germany Laid-Open Patent Application) No. 2,220,910 has similar aims, and provides that the portion of the inductor surrounding the extrados has a greater distance from the pipe surface than the portion surrounding the intrados.

For the same purpose, DE-OS No. 2,220,910 discloses a second alternative according to which nonuniform or asymmetrical heating is realized by means of sheet metal packets arranged locally along the circumference of the inductor so as to serve as yokes with which the intensity of the inductive heating can be influenced. A third, complicated and spatially difficult to manage alternative is disclosed in DE-OS No. 2,220,910 which provides that, in conjunction with such metal yokes, a first inductor is provided for preheating and a second inductor is provided for primary heating at the heating cross section.

For the same purpose, U.S. Pat. No. 4,177,661 discloses an inductor in which part of the induced energy is collected by a shield placed between the inductor and the pipe to be bent. This patent also describes an apparatus according to which an additional heating source is provided at the intrados upstream of the annular, inductively operating heating source.

However, all these known methods and apparatuses for nonuniform heating ofthe bending cross section of pipes or other elongate workpieces to be bent in a progressive manner have certain drawbacks and do not bring success or are very difficult to implement successfully.

Asymmetrical heating by means of eccentric placement or radial displacement of the inductor has the drawback that the transverse displacement of the inductor for the purpose of reducing the temperature of the extrados simultaneously results in an increase in the temperature of the intrados, although it would be preferable to change the temperature primarily only at the extrados in order to avoid undesirable wall thinning, e.g. of a pipe, at the extrados, and excessive upsetting of the intrados is likewise undesirable. Moreover, the inductors employed usually have spray holes which spray water under a certain angle in the forward direction onto the already bent pipe so as to delimit the heated zone. Transverse displacement of the inductor also changes the point at which the water jets impinge on the pipe, with the result that the width of the heated zone becomes nonuniform and thus has an adverse influence on the bending process.

The attachment of metal yokes to the inductor at the point on the inductor where a higher temperature is desired is a very complicated and time-consuming job. If, finally, the desired effect has been produced for a certain pipe wall and for the intended bending radius, the specific inductor employed is suitable only for this particular case.

The attachment of a shield between the inductor and the workpiece to be heated is difficult to accomplish in practice since the gap available between the inductor and the workpiece is small. Additionally, the shield must also be cooled with water to prevent overheating, so that practically no space is left. Here again, the end effect is difficult to predict and the position and dimensions must be determined empirically, with success being applicable only to one specific case.

The local placement of an additional heat source for the purpose of producing a higher temperature at the inner arc, i.e. at the intrados, has the drawback that the heating zone is made extra wide at that point. This is a drawback for retention of a good round pipe during bending and may also cause dents or local upsets.

The present invention is based on the recognition in the field of the invention of asymmetrically inductively heating the workpiece by placing the inductor eccentrically according to the acknowledged prior art (e.g. according to German Pat. No. 2,738,394) or, if inductor placement is concentric, on partially shielding the induction (U.S. Pat. No. 4,177,661). The former case, a priori, does not permit a concentric inductor arrangement, while the latter case is complicated and difficult to realize. The field of the invention also includes the arrangement employing metal yokes according to DE-OS No. 2,220,910 which, however, can be adjusted accurately, and in a very complicated manner, only to one particular workpiece at a time.

SUMMARY OF THE INVENTION

It is therefore the object of the present invention to provide a method and an apparatus for bending elongate workpieces, particularly pipes, employing nonuniform temperature distribution along the circumference of an inductively heated cross-sectional zone of the workpiece while permitting concentric or almost concentric inductor placement and permitting, in a simple manner, the same inductor to be used to set various bending radii.

The above object is achieved according to the invention by a method of bending elongate workpieces, particularly pipes, including inductively heating a cross-sectional zone of a workpiece with nonuniform temperature distribution along the circumference of the cross-sectional zone by means of an induction loop which surrounds the workpiece, applying a bending moment to the workpiece to bend the heated cross-sectional zone, and subsequently cooling the heated cross-sectional zone of the workpiece; and wherein the step of inductively heating comprises: dividing the electrical current of the induction loop into a plurality of partial branch currents over a partial region of the circumference of the loop adjacent the partial region of the circumference of the workpiece which is to be set at a relatively low temperature; causing at least one of the branch currents to act inductively primarily on the cross-sectional zone to be heated and at least another of the branch currents to act inductively primarily on a respective adjacent cross-sectional zone of the workpiece lying outside of the cross-sectional zone to be heated; and, at least partially cancelling out the inductive heating of the respective adjacent cross-sectional zone by cooling same.

The above object is likewise achieved according to the invention by an apparatus for bending elongate workpieces, particularly pipes, which comprises heating means for inductively heating a cross-sectional bending zone of a workpiece to different bending temperatures along the circumference of the cross-sectional bending zone with the heating means including an inductor through which the workpiece is passed so that the inductor surrounds the workpiece at the cross-sectional bending zone, means for applying a bending moment to a workpiece to bend same at the location of the heating means, and a cooling means for directing coolant onto at least one cross-sectional zone of a workpiece located adjacent to and downstream of the cross-sectional bending zone; and wherein: the inductor includes a first generally planar portion which is shaped so that it will surround the workpiece and through which the workpiece is passed, and at least one branch portion connected to the first portion and extending along a partial region of the circumference of the first portion of the inductor so that the total current supplied to the inductor will be divided between the second portion or portions and the adjacent section of the first portion of the inductor but will flow through the remaining section of the portion, with the branch portion being offset from the first portion along the longitudinal axis of the inductor so that the branch portion will inductively heat a partial region of a cross-sectional zone of a workpiece adjacent the cross-sectional zone heated by the first portion; and the cooling means includes means for directing coolant onto the region of a workpiece adjacent one of the branch portion and the partial region of the first portion of the inductor to at least partially cancel the heating provided by the branch portion or the partial region of the first portion of the inductor.

The invention makes it possible to place the inductor strictly concentrically or almost concentrically around the workpiece, i.e. at approximately the same radial distance from the object to be bent, e.g. a pipe, and to branch the inductor current, in the circumferential region of the workpiece where a lower temperature is desired, into two or more parallel currents while wholly or partially destroying the heating energy induced in the article to be bent by the branched partial currents, e.g. by means of the conventional spraying of directed and/or regulatable jets of water.

The realization of the present invention is relatively simple and is not dependent upon asymmetrical placement of the inductor with respect to the pipe. After radial adjustment with respect to the workpiece to be bent, it is usually not necessary at all, and in any case with less frequency and to a lesser extent than in the prior art methods and apparatuses, to make a radial cross-sectional adjustment, even different bending radii can be realized with the same inductor. Rather, the necessary adjustments can be made by way of the location and the degree of cooling. This permits practically any desired temperature profile to be set along the circumference of the heated cross-sectional zone of the workpiece so that undesirable upsets at the intrados can also be avoided. Stated more generally, it is possible, with respect to pipes, to reliably set the wall thickness along a pipe bent about its circumference in an easily mastered manner, even in pipes having walls of different thicknesses. This is similar with respect to the more uniform cross-sectional stress on workpieces having a solid cross section, e.g. rods, and particularly profiled rods, e.g. those having a T or H shaped profile. Also worth mentioning is the possibility of introducing the induction energy into the workpiece in a low dissipation manner and to be able to distribute it over the bending cross section. It is further possible to distribute spray members, which are combined with the inductor, uniformly over the circumference of the workpiece to be bent, particularly but not exclusively with a concentric or almost concentric arrangement of the inductor itself with respect to the workpiece.

It should be noted that in addition to cooling the partial zone adjacent the heated cross-sectional bending zone in order to completely or partially conceal the heat induced by the additional branch current, cooling of the workpiece in at least one adjacent downstream zone is desired in order to quench the already bent workpiece downstream of the cross-sectional zone that is heated to bending temperatures so as to make the workpiece a rigid lever element again as soon as possible within the entire bending device. In the prior art as well, this cooling is usually effected by jets of water, often coming directly through a plurality of small lateral apertures for the coolant in the inductor itself or from a separate cooling ring. However, there are bending devices in which cooling downstream of the heating zone is effected by means of cooling air, e.g. forcibly convected compressed air, instead of by a cooling liquid. All these possibilities fall within the scope of the present invention. This also applies to transfer of a possibility generally known only in connection with the bending of plastic pipes, i.e. cooling downstream as well as upstream of a heating zone (see U.S. Pat. No. 2,480,774).

The induction loop used according to the invention is usually an individual loop. In practice, however, the individual loop may be assembled into a wider inductor loop, for example in that two parallel induction loops are bridged by means of a metal connection. Moreover, the use of a multiple loop in the form of a helical inductor, e.g., as metioned in DE-OS No. 2,220,910 is not excluded although such use is less customary.

Generally and according to the general theory on which the present invention is based, a temperature reduction by means of branching of the inductor will be provided only on the elongation side of the arc, i.e., at the so-called extrados. However, the reverse possibility is to be included in the scope of the present invention, at least theoretically, if the teaching of German Pat. No. 2,822,613 should also offer an interpretation according to which the reverse temperature changes are provided.

In the normal case, branching will extend approximately over half the pipe circumference or half the circumference of any other workpiece. In this connection it is certainly possible to somewhat reach over the zone of elongation on both sides which is qualitatively covered by an upper limit of 60% of the workpiece circumference which should not be considered a precise numerical statement. It is here possible, with much simpler means and with a greater variety of means than is possible and desired in the above mentioned DE-OS No. 2,220,910 to bring only about one fourth to one third of the circumference to the lower temperature and the remainder of the circumference to the higher temperature, particularly a forging temperature.

It should be noted that the heating cross section need not necessarily be arranged perpendicularly to the workpiece longitudinal axis, but can also be oblique or bent at an angle to such axis, for example as shown in FIGS. 4 and 5 of DE-OS No. 2,210,715.

The present invention is not dependent on the specific manner with which the bending movement is applied. Thus it is possible to displace the workpiece axially relative to a stationary inductor or, inversely, to displace the inductor relative to a stationary workpiece or even to have the inductor and the workpiece both displaceable and adjust only for relative movement. However, it is common practice to advance the workpiece continuously or incrementally and to arrange the inductor so that it is stationary except for adjustment movements, e.g., see German Pat. No. 2,112,019. Moreover, the bending moment can be applied either by axial pressure on the unbent pipe (German Pat. No. 2,738,394) or by introducing a certain torque by way of a bending arm (see DE-OS No. 1,935,100) or in some other way, e.g. in the manner in which a bow is tensioned (see U.S. Pat. No. 783,716). Accordingly, in this respect, the present invention is not limited in any way.

Within the scope of the invention, it is possible to employ not only inductors having a circular cross section but also, for example, inductors having a polygonal, in particular rectangular, triangular or trapezoidal cross section, with the profile being disposed transversely as well as longitudinally with respect to the connections.

Branching the inductor can be effected, for example, by means of a rectangular, fork-like bent portion. However, streamlined, oblique angled portions are preferred since they not only have advantages with respect to coolant flow but may simultaneously also constitute an adaptation to different degrees of heating along the workpiece circumference.

In practice, induction frequencies between 500 and 1000 Hz may be sufficient. An induction frequency of 1000 Hz results in a heating penetration depth of about 16 mm in steel pipes, while a frequency of 500 Hz results in a heating penetration depth of about 22 mm. The relatively high frequencies are utilized for thin-walled pipes and the relatively low frequencies for thick-walled pipes. In borderline cases, lower or higher frequencies can also be employed.

The following exemplary solutions fall within the scope of the present invention:

1. Two or more partial currents act directly on the cross section to be heated.

2. More than one partial current is provided outside the primary heating zone.

These two or more partial streams may all be disposed on the same side of the inductor, particularly if they are all to be utilized for controlling or regulating the desired conditions and a larger area is required, for example to distribute the coolant over a wider area.

According to a feature of the invention, the heated partial cross-sectional zone adjacent the heating cross-sectional zone and whose inductive heating is completely or partially cancelled out, is disposed in the bent portion of the workpiece. In this way, certain portions of the current can be made ineffective for the inductive heating and additionally the coolant employed to make ineffective the inductive heating can simultaneously be utilized to quench the pipe downstream of the heated cross-sectional zone or one can at least prevent undesirable interactions from occurring between the two coolants. If, for example, water is sprayed out of the inductor to quench the bent pipe downstream of the heated cross-sectional zone, this water is permitted to mix with the cooling water provided according to the invention to make the inductive heating partially ineffective, e.g. in the sense of forming a combined spray jet. Conditions are similar for cooling with air.

It may even be conceivable to no longer actively cool the bent portion of the workpiece downstream of the respective bending location but instead to utilize the already occurring cooling of the pipe so that the already bent pipe will not become soft again. In this sense, the previously occurring cooling of the pipe would be considered to be the cooling of the bent portion which cooling would then not be applied externally but would be introduced from within the pipe. In the same sense, the pipe could be preheated by means of a branched-off partial current and could then be cooled again in that a relatively long stretch is traversed between the preheating zone and the actual heating zone which would then produce the cooling effect.

Cooling for the purpose of quenching as well as cooling according to the invention for the partial cancellation of inductive heating can also be effective, if required, from within the pipe. For example, in a triple branch it is possible to provide a regulating path upstream of the primary heating zone and a constant cooling path downstream of the heating zone. In the still unbent region, more or less heat may be introduced from the start, as required, by means of more or less intensive quenching of inductively introduced heat so that the desired temperature profile is obtained at the cross-sectional location which is to be heated to the bending temperature.

However, it has been found that it is already sufficient to effect quenching of inductively introduced heat only downstream of the cross-sectional zone of the workpiece which is subjected to bending, and to simultaneously obtain the above-explained favorable interaction with the cooling effect which is required to quench the pipe after bending.

FIGS. *2a* and *2b* are top and side views, respectively, of a conventional known inductor.

FIGS. *3a*, *3b* and *3c* are a front view (according to arrow B in FIG. *3b*), a side view and a rear view (according to arrow A in FIG. *3b*), respectively, of one embodiment of an inductor according to the present invention.

Figure 4:
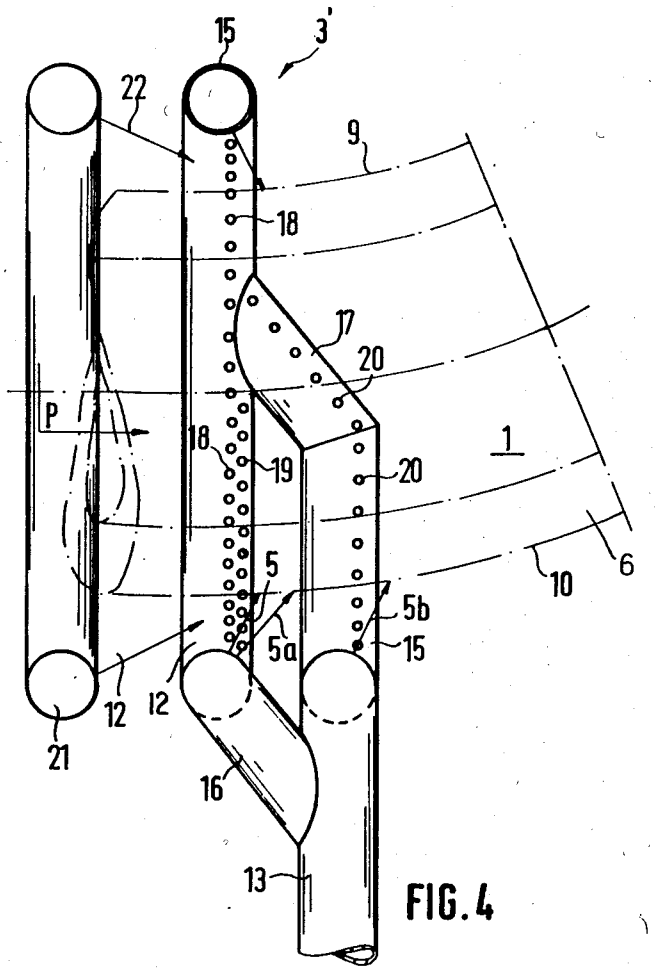

FIG. 4 is a cross-sectional view of a modified inductor according to FIGS. *3a–3c* equipped with coolant spray nozzles holes for cooling water and illustrating the relationship between the inductor and a bent pipe section to provide a heated cross-sectional zone (bending zone) which extends at a right angle to the unbent pipe.

Figure 5:
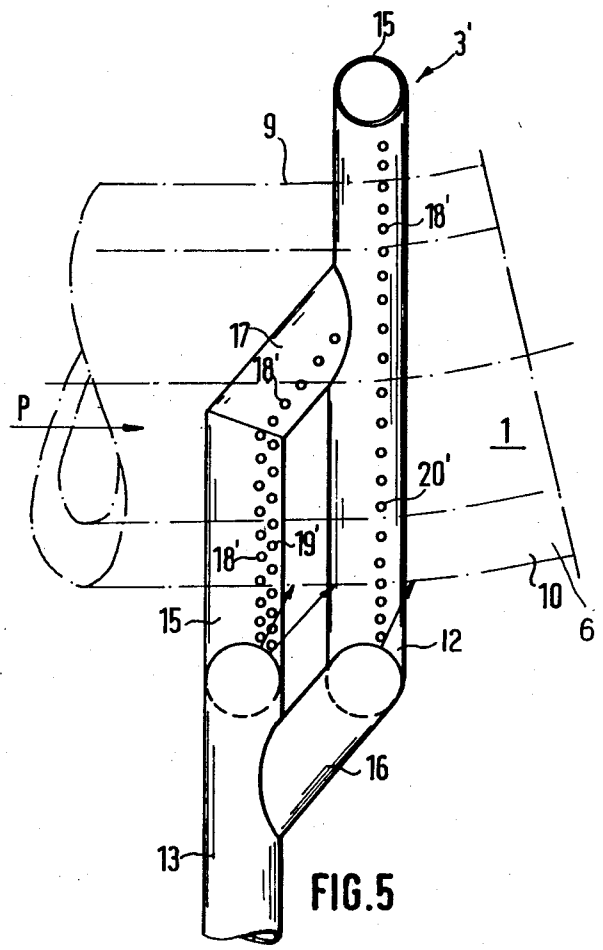

FIG. 5 is a cross-sectional view of a further modification of an inductor according to FIGS. *3a–3c* equipped with coolant spray nozzles and illustrating the relationship between the inductor and a bent pipe section to provide a heated cross-sectional zone extending obliquely or in the shape of the letter S, respectively, relative to the unbent pipe.

FIGS. *6a*, *6b* and *6c* are a front view (according to arrow B in FIG. *6b*), a side view and a rear view (according to arrow A in FIG. *6b*) respectively of a modified inductor according to the FIGS. *3a–3c*, illustrating a partial branch of the induction loop with varying distance from the workpiece FIG. 7 is a cross sectional view of an inductor according to FIGS. *3a–3c* equipped with separate coolant means provided with coolant spray nozzles.

FIG. 8 is a cross sectional view of an inductor according to FIGS. *3a–3c* equipped with separate coolant means provided with adjustable coolant spray nozzles.

FIGS. 9 and *9a* illustrate a detail of the arrangement of the adjustable coolant spray nozzles shown in FIG. 8. FIG. 9 is a front view and FIG. *9a* a view according arrow A.

FIGS. 10 and *10a* illustrate a detail of the arrangement of the adjustable spray coolant nozzles according to FIG. 9 and 9a however equipped with flat jet coolant spray nozzles. FIG. 10 is a front view and FIG. *10a* a view according arrow A.

DETAILED DESCRIPTION OF THE PREFERRED EMBODIMENTS

Figure 1:
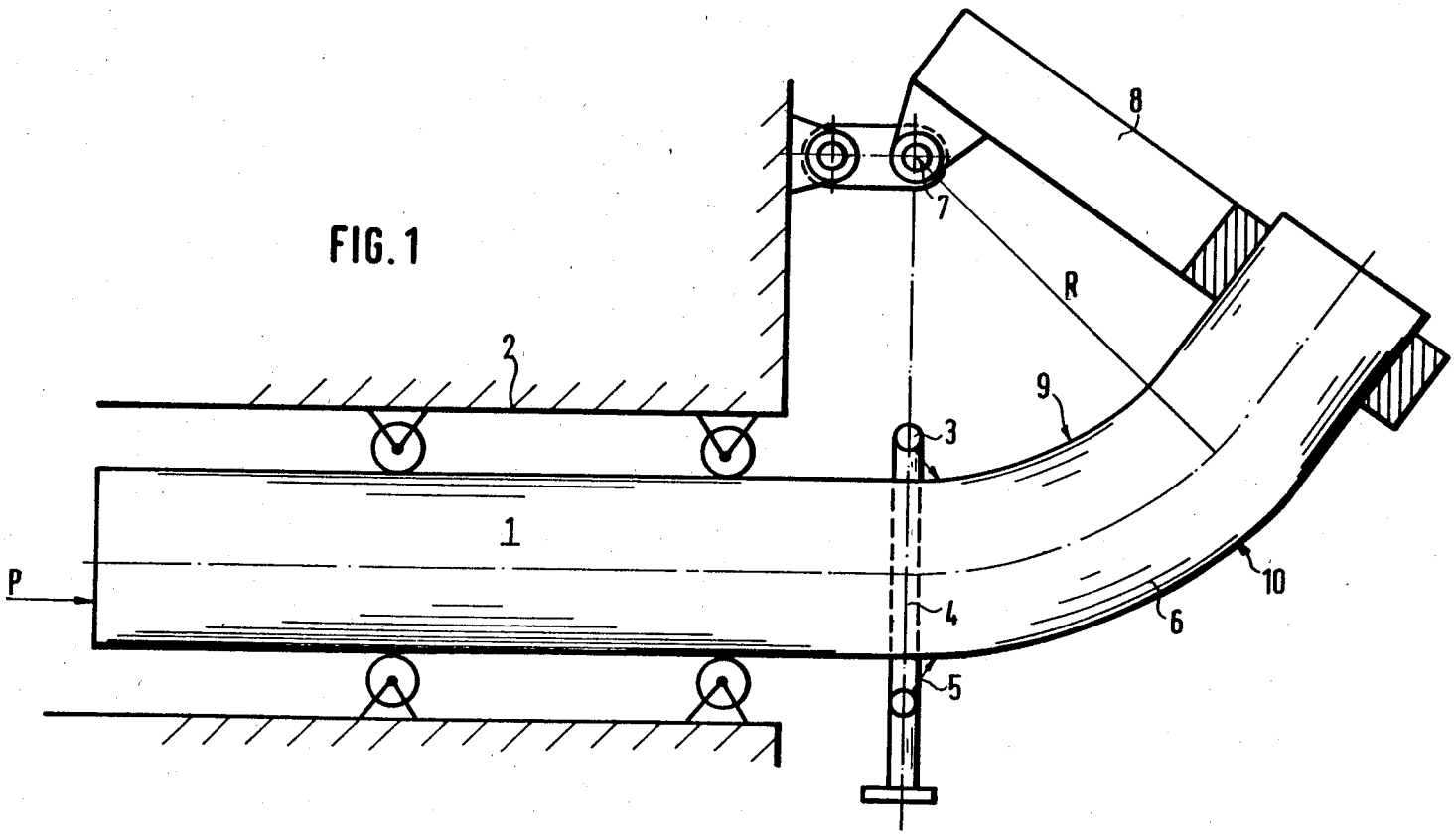
FIG. 1 is a schematic plan view of the basic structure of one example of a bending device which can be used with the present invention.

Referring now to FIG. 1, there is shown the basic principle employed in a bending device which here shall serve as the starting point for the explanation of the present invention. The workpiece to be bent, e.g. a pipe 1, is guided by a stationary guide arrangement 2 in the direction of arrow P (exertion of a pressure force P to advance the pipe) through an inductor 3 which heats the pipe in a narrow zone 4 until it reaches a temperature at which pipe 1 can be deformed in the desired manner at this zone. Downstream of heating zone 4, the pipe 1 is cooled, for example, by a circle of obliquely forwardly oriented (in the direction of advancement of the pipe) jets of water 5 coming from inductor 3 or from a separate source, and is guided in an arc around point 7 to which the bent pipe portion 6 is rigidly fastened by an arm 8 which is freely rotatable about point 7. Together with this arm 8, the already bent portion 6 of the pipe practically forms a rigid unit and thus a lever which is always perpendicular, or almost perpendicular, to the longitudinal direction of the unbent piece of pipe at a line normal to the pipe 1 extending through the heated zone 4 and the fulcrum 7. At the inner surface or arc 9, the so-called intrados, of the bent portion 6 there occurs an upsetting effect and at the outer surface or arc 10, the so-called extrados, there occurs an elongating effect. The degree of upsetting and elongation depends on the bending radius R and on the temperature or the deformation resistance, respectively, of the material to be bent at the different locations. Notwithstanding the simplified illustration shown here, adjustability of the stated parameters, e.g. point 7, in the sense of the above mentioned DE-PS No. 2,112,019, also falls within the scope of the present invention.

The bending moment is determined by the pipe cross section and the strength (elongation at rupture) of the material employed. As a rule of thumb, one can use:

$$M_b=(Da-S)^2\cdot S\cdot\sigma_t$$

where $M_b$=bending moment in kgcm (or Ncm);

Da=outer diameter of the pipe in cm;

S=wall thickness in cm; and $\sigma_t$=yield stress of the material at temperature t in $kg/cm^2$ (or $Ncm^{-2}$)

The required bending moment $M_b$ is introduced into the pipe by a thrust P and the lever (bending radius R) according to the formula $M_b=P\cdot R$.

This shows that with decreasing bending radius, the required thrust P, and thus also the upsetting force exerted on the heated zone, becomes greater. With the temperature of the intrados and extrados remaining the same, the wall at the extrados becomes thinner with decreasing bending radius. If the temperature at the intrados is increased with respect to the extrados, the inner wall will be upset more and the outer wall will be elongated less, i.e. will not become as thin. Therefore, a good temperature setting, possibly regulated, (automatic controlled) is very important.

A conventional inductor 3, as it may be customarily employed in the bending device shown in FIG. 1, is shown in FIGS. *2a* and *2b*. As shown, the inductor 3 comprises a pipe or tube 12 which is bent in a plane to form a simple, circular induction loop 11. The pipe 12 is made of a material which is conductive for medium frequency current (500 to 1000 Hz), e.g, copper or a copper alloy. The free inner cross section of induction loop 11 is dimensioned so that pipe 1 can be brought through the loop approximately coaxially with the loop at a radial distance therefrom as shown in FIG. 1. At one point of the circumference of induction loop 11, two connecting pipes 13 extend radially from induction loop 11. The pipes 13 are somewhat bent apart at a distance from one another at their free ends which are each provided with a connecting flange 14. Connecting flanges 14 serve to connect the inductor 11 to an induction power supply (not shown) which operates at the above-mentioned medium frequency and advisably also to a source of cooling water. This latter connection is particularly also applicable if spray nozzles for cooling water jets 5 of FIG. 1 are provided in the induction loop 11 at axially forward and radially inwardly oriented angles. In this case, induction pipe 12 simultaneously serves as a cooling water conduit for cooling water conducted from one connecting flange 14 to the other. If inductor 3 is not to serve additionally as a cooling water spray member, the same stream of cooling water (or stream of another cooling fluid) may serve to cool the inductor 3.

FIGS. *3a*, *3b* and *3c* show one embodiment of an inductor 3' according to the invention which is a modification of the known inductor embodiment according to FIGS. *2a and 2b*. As in the case of FIGS. *2a* and *2b*, induction pipe 12 forms a circular induction loop 11 which is in communication with connecting pipes 13 at one point of the circumference of the loop 11. The conditions are essentially the same as in the embodiment according to FIGS. *2a* and *2b*, so that reference can be made thereto and to the description of these figures where it coincides, e.g. with respect to the connecting flanges 14 which are not again shown separately.

According to the present invention the portion of the induction loop 11 which is to be adjacent the portion of the workpiece or pipe 1 to be bent which is to be heated to a relatively low temperature, i.e., the bottom portion of the induction loop of FIG. 3, is provided with at least one electricaly parallely connected branch portion whereby the heating current will be divided between the parallely connected portions of the induction loop, and with the parallely connected branch portions being generally disposed in parallel planes which are laterally displaced along the longitudinal axis of the loop. This is achieved according to the embodiment of the invention shown in FIGS. *3a–3c* by respective branch on bypass line 15, formed also of inductor tubing such as that used for pipe 12, which is connected to each connecting pipe 13 and extends over a section of the adjacent portion of pipe 12. In the illustrated embodiment of the two branch lines 15 extend over approximately 60% of the circle described by the pipe 12, and thus also over about 60% of the circumference of the pipe 1 to be inserted. Generally, the bypass lines 15 should extend over 20–60% of the circle described by inductor pipe 12 and preferably over 25–40% of such circle. When seen from the front (FIG. *3c*), these bypass lines 15, which extend in a plane parallel to the circular pipe 12 are flush or congruent with the pipe or tube 12.

Without limitation as to generalities, the branch or bypass lines 15 in the illustrated embodiment change directly into the respective connecting pipes 13, and the free ends of pipe 12 are each connected, by means of a respective oblique connecting pipe 16, with the relatively associated connecting pipe 13. The free ends of the bypass lines 15 are each connected, by means of a respective oblique connecting pipe 17, with the adjacent section of pipe 12. The plane of the bypass lines 15 here coincides with the plane of the connecting pipes 13, while the plane of pipe 12 is axially offset with respect thereto. The direction of the slope of connecting pipes or tubes 16 and 17 here corresponds to the arrows indicating the direction of flow of the coolant through inductor 3'.

In the embodiment according to FIGS. *3a* to *3c*, it is assumed that the coolant serves merely to cool inductor 3' but not to cool pipe 1. In this case, special coolants (not shown) are provided to partially or completely cancel out the inductive heating produced by branch or bypass lines 15 in the pipe 1.

FIGS. 4 and 5 now show two modifications of the inductor 3' of FIGS. *3a* through *3c* in an application in which the inductor 3' itself serves as the coolant source acting on pipe 1. The basic configuration of inductor 3' is the same in each of FIGS. 4 and 5 as in FIGS. *3a* through *3c*. It is worthy of special note, however, that there is a certain sequence, i.e. a different sequence in FIGS. 4 and 5, of the circular pipe 12 on the one hand and the branch or bypass lines 15 on the other hand with respect to the direction of placement of pipe 1, which direction here coincides with the direction of the arrow indicating the exertion of pressure P. In conjunction with the fact that inductor 3' itself is the spray member for cooling water jets 5 which act on pipe 1, the two alternative arrangements of FIGS. 4 and 5 also result in different arrangements of the spray nozzles for the cooling jets.

With respect to the elements of inductor 3', reference can again be made to the preceding description of FIGS. *3a* through *3c* in conjunction with FIGS. *2a* and *2b*.

In the arrangement according to FIG. 4, the circular pipe or tube 12 forming a portion of the induction loop 11 is disposed upstream or in front of the branch or bypass line 15 in the direction of displacement of pipe 1. In the sense of the invention, the induction loop formed by pipe 12 here produces a narrow heating zone 4 which is disposed at a right angle to the longitudinal axis of the unbent portion of the pipe. The front or leading edge of heating zone 4, when seen in the direction of displacement, i.e. the edge facing the already bent pipe portion 6, is produced by a first row of water jet nozzles 18 formed in the inner surface of the pipe 12 adjacent its trailing edge. These nozzles 18 direct jets of water 5 obliquely forward and radially inwardly toward pipe 1 as shown in FIGS. 1 and 4 and form the abovediscussed quenching edge of heating zone 4 on pipe 1.

For the partial or complete cancellation of the inductive heating effect on pipe 1 from branch or bypass lines 15, two further groups of water jets 5a and 5b from two respective further rows of water jet nozzles 19 and 20 are directed obliquely forward and radially inwardly onto pipe 1. These nozzles 19 and 12 face the bent portion 6 of pipe 1 and are distributed respectively along the circumference of the pipe 12 in the portions adjacent the respective branch or bypass lines 15, still at the trailing edge of pipe 12, and at the trailing edge of the branch or bypass lines 15. It can be seen, water jet nozzles 20 also extend along the trailing edge of each connecting pipe 17.

With the axially reversed (by 180° ) arrangement of the inductor 3' according to FIG. 5, wherein the branch or bypass lines 15 are arranged upstream in front of the plane of the circular pipe 12 when seen in the direction of displacement of pipe 1, i.e. facing bent pipe 1, the heated cross-sectional zone 4 of pipe 1 is given a generally S shape in that it is described by bypass lines 15, the associated connecting pipes 17, and that circumferential section of pipe 12 with which bypass line 15 including connecting pipes 17 is not connected in parallel. Accordingly, with this arrangement, the first row of water jet nozzles 18' has a corresponding S shape and extends over all of the abovementioned three elements of inductor 3'. The axial sequence of the further rows of water jet nozzles 19 and 20 is then the same as in the case of the embodiment of FIG. 4, but they are disposed on other elements of the inductor 3'. For example, water jet nozzles 19 here are disposed in bypass line 15 and water jet nozzles 20 are disposed at those regions of pipe 12 which are connected in parallel with the branch or bypass lines 15.

In the two arrangements shown in FIGS. 4 and 5, water jet nozzles 19 and 20 cancel out part or all of the inductive heating of pipe 1 in the circumferential section which is adjacent bypass lines 15 (FIG. 4), or which is adjacent the portion or pipe 12 in parallel with bypass lines 15 (FIG. 5). That means that in the section of pipe 12 is parallel to bypass lines 15 (FIG. 4) and in the bypass lines 15 (FIG. 5), less heat is exerted by inductor 3' on pipe 1 than in the region in which pipe 12 is without branches and the full induction heat becomes effective in pipe 1. By correspondingly sloping connecting pipes 17 and correspondingly arranging water jet nozzles 19 and 20, the transition between the different heating zones along the circumference of the pipe can be adjusted as desired. It can be seen that in the embodiments of FIGS. 4 and 5, heating at intrados 9 is intensive and at extrados 10 it is weak since the full induction heat becomes effective in the heating zone at the intrados 9 while in the region of the extrados 10 the induction heat is reduced.

In a conventional manner (not shown), and if induction pipe 12 and pipe or tube sections 15–17 are formed of the same material, the individual pipe or tube sections forming inductor 3' can be adapted by selecting different cross sections for various sections and possibly selecting this wall thicknesses in such a manner that branching of the current in the individual line sections occurs strictly according to the Kirchhoff law, or, alternatively, in a desired, deviating manner. The metal cross section of bypass line 15 and of the parallel branch line section of circular tube or pipe 12 may here be selected to be identical or different, as desired.

The arrangement of FIG. 4 will further serve to explain an auxiliary element which may also be provided in the arrangement according to FIG. 5. This is a blow pipe 21 which is equipped with air jet nozzles and which is connected upstream of inductor 3' when seen in the direction of advance of pipe 1. The blow pipe 21, as indicated by arrows 22, produces a stream of obliquely inwardly and forwardly directed air flowing in the direction toward pipe 1 which is being pushed through inductor 3'. In this way, it is assured that the cooling water exiting from water jet nozzles 18, 19 and 20 cannot escape to the narrow crosssectional zone 4 of the pipe to be heated. The intensity and direction of the blower jets of blow pipe 21 must be adapted accordingly to the intensity and direction of the cooling water jets from the above-mentioned cooling water nozzles 18 through 20.

For gradually reducing the scanning of the inductive power and at the same time spreading out the inductive power on the workpiece, the partial branches 15*a* shown in the embodiment of FIGS. 6*a* to *c* may be positioned on a varying distance from the work piece 1 that means excentric with respect to the inductor loop 12. This arrangement can be of advantage for easyer cancelling the inductive heat by water jets from the inductor itself as shown in FIG. 4, or from a separate cooling means.

As already explained in connection with the embodiments according to FIGS. 3*a* and 3*b*, it is also possible to provide, instead of the cooling water jets 5 exiting from inductor 3' itself, special cooling members which are arranged, separately from inductor 3', in a ring or part of a ring around pipe 1 at suitable locations and in a suitable configuration. Such an arrangement is shown in FIG. 7 in which 3' is the inductor, 21 the circular cooling member provided with water jets 5 and 22 the partial cooling member provided with cooling water jets 5*b*. Although this is more costly than the combined design according to FIGS. 4 and 5 where the inductor 3' simultaneously serves as the cooling member, it has the advantage of being more flexible in application of coolant. Also the amount of coolant can easily be controlled by means of valves 23 and 24. In a particularly simple manner, individual nozzles or groups of nozzles 25 can be designed (see FIG. 8, FIG. 9 and FIG. 9*a*) to be adjustable with respect to the quantity of coolant by means of valves 26 and preferably also with respect to the direction of coolant flow by means of hinges 27. It is also possible to use the sometimes desirable flat jet nozzles as shown in FIG. 10 and FIG. 10*a*.

It will be understood that the above description of the present invention is susceptible to various modifications, changes and adaptations, and the same are intended to be comprehended within the meaning and range of equivalents of the appended claims.

What is claimed is:

1. In a method of bending elongate workpieces, particularly pipes, including: inductively heating a cross-sectional zone of a workpiece with a nonuniform temperature distribution along the circumference of said cross-sectional zone by means of an induction loop which surrounds the workpiece, applying a bending moment to the workpiece to bend the heated cross-sectional zone, and subsequently cooling the heated cross-sectional zone of the workpiece; the improvement wherein said step of inductively heating comprises: dividing the electrical current of the induction loop into a plurality of partial branch currents over a partial region of the circumference of the loop adjacent the partial region of the circumference of the workpiece which is to be set at a relatively low temperature; causing at least one of said branch currents to act inductively primarily on said cross-sectional zone to be heated and at least another of said branch currents to act inductively primarily on a respective adjacent cross-sectional zone of the workpiece lying outside of said cross-sectional zone to be heated; and, at least partially cancelling out the inductive heating of said respective adjacent cross-sectional zone by cooling same.

2. A method as defined in claim 1 wherein said adjacent cross-sectional zone with at least partial cancellation of the inductive heating is disposed in the bent portion of the workpiece.

3. A method as defined in claim 1 wherein said step of dividing includes brancing off 30 to 50% of the total current of the induction loop as partial current in said at least another of said branch currents to primarily act on at least one adjacent cross-sectional zone.

4. A method as defined in claim 1 wherein the degree of cancellation of the inductive heating of the workpiece in the respective said adjacent cross-sectional zone is selected by setting the degree of cooling of said cross-sectional adjacent zone.

5. A method as defined in claim 4, wherein said step of cancelling includes cancelling from 30 to 100% of the inductively introduced quantity of heat in said adjacent cross-sectional zone.

6. A method as defined in claim 1 wherein said step of cancelling includes cooling the inductively heated said adjacent cross-sectional zone with cooling water and/or cooling air.

7. A method as defined in claim 1 further comprising arranging the current portions of the induction loop which act primarily inductively on said cross-sectional zone to be heated to be concentric or almost concentric with respect to the workpiece.

8. A method as defined in claim 1 further comprising causing the said at least another partial branch current of the induction loop which acts inductively on a respective said adjacent zone cross-sectional to describe a path which lies at a varying distance from the workpiece.

9. A method as defined in claim 1 wherein said step of cancelling includes providing different degrees of cooling along the circumference of the workpiece to cause the inductive heating of the respective said adjacent cross-sectional zone to be cancelled out to different degrees.

10. A method as defined in claim 1 wherein said step of dividing includes effecting the branching of the electrical current of the induction loop along 20 to 60% of the circumference of the workpiece.

11. A method as defined in claim 10 wherein the branching of the electrical current of the induction loop is effected along 25% to 40% of the circumference of the workpiece.

12. Apparatus for bending elongate workpieces, particularly pipes, comprising in combination: heating means for inductively heating a cross-sectional bending zone of a workpiece to different bending temperatures along the circumference of said cross-sectional bending zone, said heating means including an inductor through which the workpiece is passed so that said inductor surrounds the workpiece at said cross-sectional bending zone; means for applying a bending moment to a workpiece to bend same at the location of said heating means; and a cooling means for directing coolant onto at least one cross-sectional zone of a workpiece located adjacent to and downstream of the cross-sectional bending zone; the improvement wherein: said inductor includes a first generally planar portion which is shaped so that it will surround the workpiece and through which the workpiece is passed; and at least one branch portion connected to said first portion and extending along a partial region of the circumference of said first portion of said inductor so that the total current supplied to said inductor will be divided between said second portion and the adjacent section of said first portion of said inductor but will flow through the remaining section of said first portion, said branch portion being parallely offset from said first portion along the longitudinal axis of said inductor so that said branch portion will inductively heat a partial region of cross-sectional zone of a workpiece adjacent the cross-sectional zone heated by said first portion; and said cooling means includes means for directing coolant onto the region of a workpiece adjacent one of said branch portion and said partial region of said first portion of said inductor to at least partially cancel the heating provided by said branch portion or said partial region of said first portion of said inductor.

13. Apparatus as defined in claim 12 wherein said one of said branch portion and said partial region of said first portion in which the heating is cancelled out is located downstream of said cross-sectional bending zone, and said cooling means directs said coolant onto the bent portion of the workpiece.

14. Apparatus as defined in claim 12 wherein: said first and branch portions of said inductor are each formed by a metal tube; means are provided for causing liquid coolant to flow through said tubes; and said branch portion is connected in parallel with said partial region of said first portion, both electrically and with respect to said flow of coolant.

15. Apparatus as defined in claim 13 wherein said inductor includes only one of said branch portions.

16. Apparatus as defined in claim 15 wherein said branch portion is designed in the same manner as said first portion.

17. Apparatus as defined in claim 15 wherein said tube forming said branch portion differs in its metal cross section from the said tube forming said first portion.

18. Apparatus as defined in claim 14 wherein said cooling means includes jet nozzles disposed in said first and branch portions of said tubes forming said inductor.

19. Apparatus as defined in claim 14 wherein said cooling means for directing coolant onto the workpiece is separate from said means for causing a liquid coolant to flow through said tubes forming said inductor.

20. Apparatus as defined in claim 19 wherein said cooling means includes means for adjusting the coolant quantity.

21. Apparatus as defined in claim 12 further comprising means for adjusting the direction of coolant emission onto the workpiece.

22. Apparatus as defined in claim 12 wherein said cooling means includes flat jet nozzles.

* * * * *